US011374355B2

(12) United States Patent
Recknagel

(10) Patent No.: US 11,374,355 B2
(45) Date of Patent: Jun. 28, 2022

(54) SLIPRING HOUSING WITH BAYONET LOCK

(71) Applicant: Schleifring GmbH, Fürstenfeldbruck (DE)

(72) Inventor: Jens Recknagel, Gilching (DE)

(73) Assignee: SCHLEIFRING GMBH, Furstenfeldbruck (DE)

( * ) Notice: Subject to any disclaimer, the term of this patent is extended or adjusted under 35 U.S.C. 154(b) by 0 days.

(21) Appl. No.: 17/547,408

(22) Filed: Dec. 10, 2021

(65) Prior Publication Data

US 2022/0102912 A1 Mar. 31, 2022

Related U.S. Application Data

(63) Continuation of application No. PCT/EP2020/061044, filed on Apr. 21, 2020.

(30) Foreign Application Priority Data

Jun. 14, 2019 (EP) ..... 19180216

(51) Int. Cl.

| | |
|---|---|
| ***H01R 13/625*** | (2006.01) |
| ***H01R 13/66*** | (2006.01) |
| ***H01R 39/64*** | (2006.01) |
| ***H01R 39/14*** | (2006.01) |
| ***H01R 39/10*** | (2006.01) |

(52) U.S. Cl.

CPC ..... *H01R 13/625* (2013.01); *H01R 13/6658* (2013.01); *H01R 39/10* (2013.01); *H01R 39/14* (2013.01); *H01R 39/643* (2013.01)

(58) Field of Classification Search

CPC ..... H01R 13/625; H01R 39/10; H01R 39/14; H01R 39/04; H01R 39/02; H01R 39/643

See application file for complete search history.

(56) References Cited

U.S. PATENT DOCUMENTS

| | | | | |
|---|---|---|---|---|
| 4,485,278 | A | 11/1984 | Schaller et al. | |
| 7,246,567 | B2 * | 7/2007 | Shelton | B63G 8/001 114/312 |
| 2008/0192975 | A1 | 8/2008 | Ito | |

FOREIGN PATENT DOCUMENTS

| | | |
|---|---|---|
| CH | 246799 | 1/1947 |
| CN | 108808314 A | 4/2020 |
| EP | 1026794 | 8/2000 |
| EP | 2696443 | 2/2014 |

(Continued)

OTHER PUBLICATIONS

Extended European Search Report & Opinion issued in priority European Application No. 19180216.4, dated Dec. 17, 2019.

(Continued)

*Primary Examiner* — Oscar C Jimenez
*Assistant Examiner* — Paul D Baillargeon
(74) *Attorney, Agent, or Firm* — Norton Rose Fulbright US LLP

(57) ABSTRACT

A slipring device includes a first part and a second part rotatable against each other. Both parts include housings with slipring components. A first housing at the first part has a hollow shaft with a bayonet lock notch to engage with a locking ring having at least one bayonet lock protrusion. The locking ring can easily be attached by a bayonet lock to lock the first part and the second part together.

15 Claims, 6 Drawing Sheets

(56) References Cited

FOREIGN PATENT DOCUMENTS

| | | |
|---|---|---|
| EP | 3096175 | 11/2016 |
| EP | 3316425 | 5/2018 |

OTHER PUBLICATIONS

International Search Report & Written Opinion issued in PCT/EP2020/061044, dated Aug. 10, 2020.
Search Report issued in corresponding Chinese application No. 2020800387588, dated Apr. 20, 2022.

* cited by examiner

SLIPRING HOUSING WITH BAYONET LOCK

CROSS-REFERENCE TO RELATED APPLICATIONS

This application is a continuation of pending International Application No. PCT/EP2020/061044 filed on 21 Apr. 2020, which designates the United States and claims priority from European Application No. 19180216.4 filed on 14 Jun. 2019, both of which are incorporated herein by reference.

BACKGROUND

1. Field of the Invention

The invention relates to slipring devices for transmission of electrical signals between rotating parts. Specifically, it relates to housings of such slipring devices.

2. Description of Related Art

Electrical sliprings are used to transfer electrical power and/or signals between a rotating and a stationary part. Such sliprings are used in different applications, like wind energy plants or computer tomography scanners. There exist also many industrial, military, and aerospace applications in which sliprings are used.

Specifically for industrial applications, the sliprings should have a housing which allows simple integration into complex machines. The housing further should provide a sufficient protection against dust, debris, and liquids. Furthermore, the housing should allow easy disassembly of the slipring device for maintenance purposes.

A very robust and complex multifunctional slipring housing is disclosed in EP 2 696 443 B1. It has a very high degree of sealing, but requires a large number of screws to be removed for opening the housing.

EP 1 026 794 B1 discloses a slipring in a plate-like arrangement. Due to the complex interior assembly and the multiply screwed housing, the disassembly is only possible with extremely high efforts.

U.S. Pat. No. 4,485,278 discloses a device for automatically winding up a feeder cable. Here, a spring housing is attached by a bayonet lock to a drum. The housing parts are held by a snap lock connection (locking pawls 1.2). There is also no hollow shaft including at least one bayonet lock notch and no locking ring having at least one bayonet lock protrusion oriented in a radial direction to the center axis.

EP 3 096 175 A2 discloses binoculars having a sliding contact connection. There is also no hollow shaft including at least one bayonet lock notch and no locking ring having at least one bayonet lock protrusion oriented in a radial direction to the center axis. Instead of the locking ring, there is a pin 6 (FIG. 15) which protrudes into the tubular protrusion and interfaces with the first part (5).

US 2008/0192975 A1 discloses a sliding contact device having a printed circuit board. EP 3 316 425 A1 discloses a 3D-printed slipring module. CH 246 799 discloses a stacked slipring arrangement.

SUMMARY

The embodiments are providing a slipring device and a slipring housing which can easily be integrated in a complex environment and which further can easily be assembled in manufacturing and which can easily be disassembled for maintenance.

Solutions of the problem are described in the independent claims. The dependent claims relate to further improvement of the invention.

A slipring device includes a first part and a second part which are rotatable against each other about a center axis. For example, the first part may be stationary, whereas the second part may be rotating relative thereto. Of course, the rotating and stationary parts may be exchanged or even both parts may be rotating with different speeds.

The first part includes a first housing which may contain all necessary slipring components. Such a component may be at least one sliding track and/or one sliding brush. The slipring component may include a printed circuit board which may have a sliding track as a PCB trace, and/or a brush mounted and/or soldered to the PCB.

The second part arranged opposite to the first part also has a second housing and may further include slipring parts, like at least one a sliding track and/or one sliding brush. The slipring component may include a printed circuit board which may have a sliding track as a PCB trace, and/or a brush mounted and/or soldered to the PCB.

The slipring components in the first part and the second part are designed such that they interface in a way to form a sliding contact connection. Therefore, a contact brush at the first part interfaces with the sliding track at the second part and/or a contact brush at the second part interfaces with a sliding track at the first part. Multiple sliding contact connections may be provided between the first part and the second part.

For holding the first part and the second part in a spatial relationship and allowing rotation therebetween, at least one bearing may be provided. Such a bearing may be a slide bearing, a ball bearing, a liquid bearing or any other suitable bearing. A ball bearing and optionally two ball bearings may be provided. Also, a combination of bearings may be used. Furthermore, the first housing includes a hollow shaft which serves as a guidance for the second part and holds a locking means which may be a locking ring. The hollow shaft may have a free inner bore over its total length. This may allow to feed cables, waveguides and pipes through the hollow shaft and may even allow to insert further rotary joints. The locking ring holds and locks the first part against the second part. There may be a spring between the locking ring and the first and/or second part to ensure a certain and may ensure a constant pressure between the first and the second part to hold these parts in place. The spring may be a wave spring or plate spring or a disk spring. The spring may be formed as one part with the locking ring. In an embodiment, the locking ring may be a 3D printed part which has an integrated spring or multiple springs. This is a significant advantage over standard manufacturing methods, as these do not allow to combine the spring with the locking ring. Anyway, any part of the device may be made by a 3D printing process. High-volume manufacturing may be performed by injection-molding.

In an embodiment, the locking ring may have a bayonet lock which allows simple assembly and disassembly of the slipring device. In an alternate embodiment, the locking ring may also have a thread or any other means for holding it in position.

In an embodiment, the hollow shaft may have at least one notch or a plurality of notches, and the locking ring has at least one protrusion for interfacing with the notches of the hollow shaft. The protrusion may be oriented in a radial direction to the center axis. The order of the notches and protrusions may be exchanged.

Assembly of the slipring device is very simple. The second part only has to be placed on the hollow shaft of the first part. In a next step, the locking ring has to be placed on the hollow shaft and to be locked. Locking may be done by locking the bayonet lock by pressing the locking ring down in a locking position and then rotating the locking ring until the bayonet lock locks. To unlock and disassemble the housing e.g. for service the locking ring may be rotated in the opposite direction. The direction may be counter clockwise for disassembly and clockwise for assembly.

In another embodiment, the slipring device has a bearing arranged between the hollow shaft and the second housing. The locking ring is attached to the outside of the hollow shaft and is configured to hold the second housing against the first housing in a defined position. It may prevent the second housing from sliding off the first housing. The locking ring may be configured to hold the bearing in its position at the hollow shaft.

The housing parts when manufactured from plastic material e.g. in a 3D printing process or injection molding process might incorporate metal threaded inserts to allow stable mounting of the slipring to a customer interface or to mount a torque bridge. Also, a metal or absorbent coating might be applied to the inner housing surface for shielding of the slipring to reduce electromagnetic emissions or improve electromagnetic susceptibility of the slipring.

In another embodiment, the housing may include a metal, e.g. aluminum. The first housing and/or the second housing may include metal.

In another embodiment, the first bearing is arranged between the first housing and the second housing in a direction parallel to the center axis.

In a further embodiment, the hollow shaft holds the second part and/or the second housing.

A simple position encoder can also be integrated by 3D printing a resistive substrate formed as a circle with the center at the rotation axis onto the inner surface of one part of the housing. The substrate is contacted by at least one electrode static to the printed substrate and a metal brush that is mounted to the other part of the housing and that moves angularly with the rotation of the slipring so that an absolute or relative resistor value measured between the sliding brush and the at least one static electrode represents an angular position between the two housings to serve as an encoder. The housing might also only partially cover the slipring to reduce costs or mass or inertia of the slipring. Connectors might be mounted to the housing or to at least one of the printed circuit boards.

BRIEF DESCRIPTION OF THE DRAWINGS

In the following, the invention will be described by way of example, without limitation of the general inventive concept, on examples of embodiment and with reference to the drawings.

Figure 1:
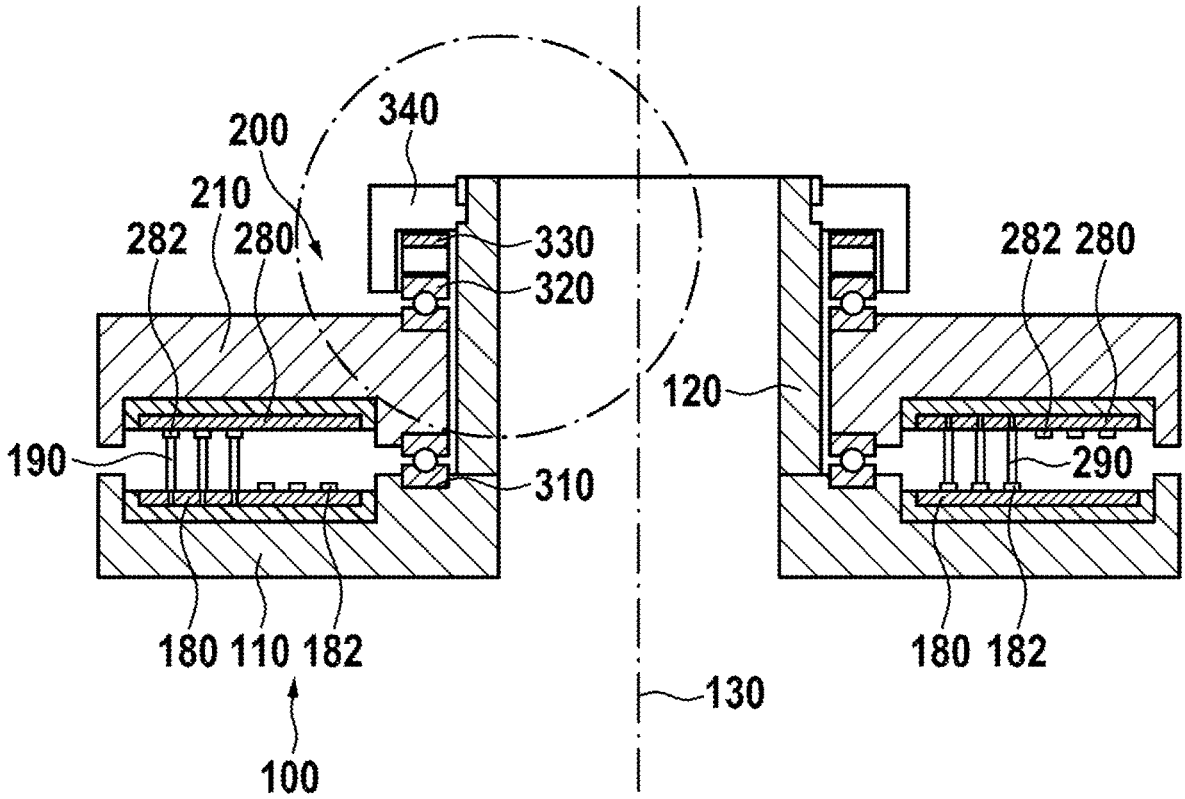
FIG. 1 shows a first embodiment of a slipring device.

Generally, the drawings are not to scale. Like elements and components are referred to by like labels and numerals. For the simplicity of illustrations, not all elements and components depicted and labeled in one drawing are necessarily labels in another drawing even if these elements and components appear in such other drawing.

While various modifications and alternative forms, of implementation of the idea of the invention are within the scope of the invention, specific embodiments thereof are shown by way of example in the drawings and are described below in detail. It should be understood, however, that the drawings and related detailed description are not intended to limit the implementation of the idea of the invention to the particular form disclosed in this application, but on the contrary, the intention is to cover all modifications, equivalents and alternatives falling within the spirit and scope of the present invention as defined by the appended claims.

DETAILED DESCRIPTION

In FIG. 1, a first embodiment of a slipring device is shown. The slipring device basically includes a first part 100 and a second part 200, which are rotatable against each other about a center axis 130. The first part 100 has a first housing 110 which holds a first printed circuit board (PCB) 180. This PCB may hold at least one first sliding track 182 and/or at least one contact brush 190.

The second part 200 has a second housing 210 with a second PCB 280. The second PCB 280 may have at least one second contact brush 290 and at least one second sliding track 282. The sliding tracks and brushes are arranged such that a sliding track of the first PCB interfaces with a sliding brush of the second PCB, and vice versa to accomplish an electrical contact. Between the first housing 110 and the second housing 210 is at least a first bearing 310 which provides mechanical support and allows rotation of the second housing against the first housing. There may be at least a second bearing 320. The first housing 110 has a hollow shaft 120 which may serve as a centering means. Attached to the hollow shaft 120 is a locking ring 340 which may be configured to press in a direction of the center axis 130 against a spring 330 to hold the second housing against the first housing in a defined position. The locking ring may have a bayonet lock by which it is locked against the hollow shaft 120. The locking ring may be attached to the outside of the hollow shaft. The inner diameter of the locking ring may be larger than the outer diameter of the hollow shaft.

Figure 2:
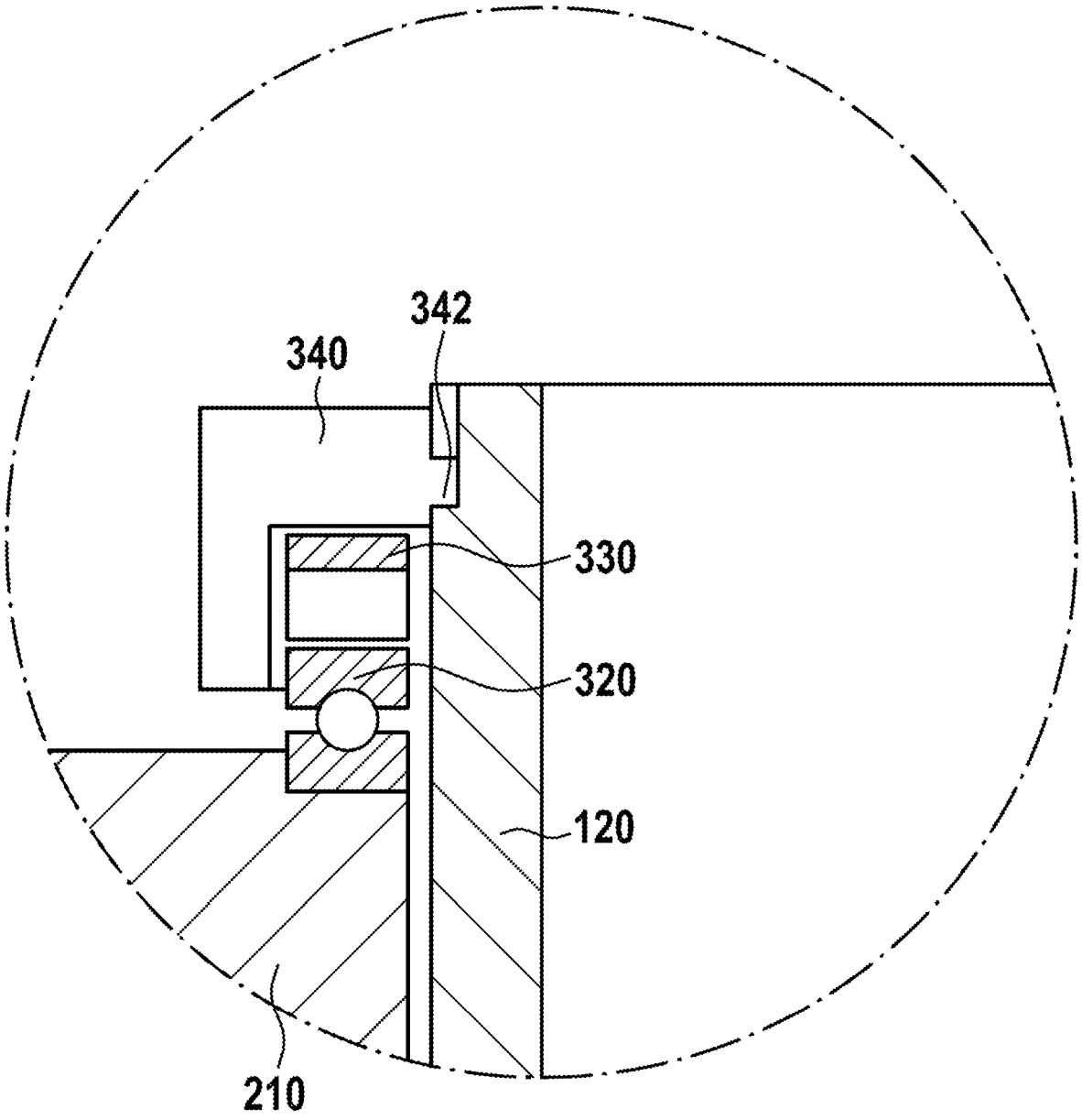
FIG. 2 shows a detail of the locking ring with bayonet lock.

In FIG. 2, a detail of the locking ring with bayonet lock is shown. The locking ring 340 may have a bayonet lock protrusion 342. This protrusion is guided in a bayonet lock notch 122 at the hollow shaft 120. The bayonet lock notches and the bayonet lock protrusions are arranged such that they match to each other. In an embodiment, there exit at least two, or at least three or even more bayonet lock notches and adapted bayonet lock protrusions. In an embodiment, there may be three such bayonet lock notches and bayonet lock protrusions under an angle of 120 degrees to each other. In general, the bayonet lock notches may be arranged equidistant.

For assembly, the locking ring is placed on the top of the hollow shaft and the bayonet lock protrusion 342 may be inserted into the bayonet lock notch 122 and pushed downwards. In a next step, the locking ring may be rotated such that the protrusion engages with the bayonet lock and the locking ring 340 may be held in place.

Figure 3:
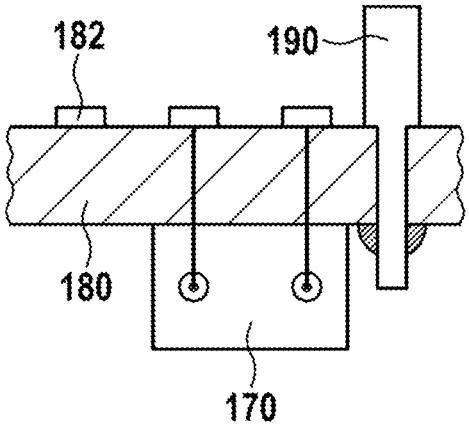
FIG. 3 shows the slipring in detail.

In FIG. 3 a slipring is shown in detail. A first printed circuit board (PCB) 180 may be mounted to a first housing as shown in FIG. 1. This PCB 180 may hold at least one first sliding track 182 and/or at least one contact brush 190. A first connector 170 may be mounted to the PCB and connector pins may be connected to the tracks. The connector may accessible by an opening of the first housing. There may also be at least one connector at the second PCB.

Figure 4:
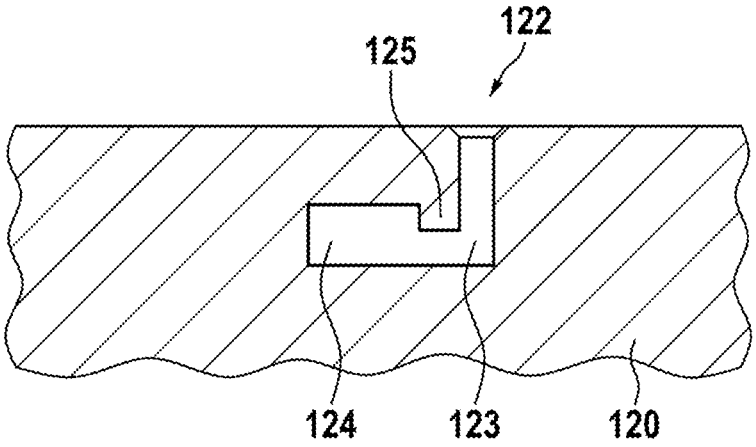
FIG. 4 shows a further detail of the bayonet lock.

In FIG. 4, a detail of the bayonet lock is shown. Basically, this is a side view of a section of the hollow shaft 120. Here, the bayonet lock notch 122 is shown in detail. This notch may have a first section 123 which goes into a direction such that the compression of the spring is increased. A second section 124 may be under a right angle to the first section. This section can be reached by the bayonet lock protrusion 342 by rotating the locking ring. To prevent loosening of the locking ring, there may be a notch 125 which prevents returning of the bayonet lock protrusion 342 into the first section. Normally, after the locking ring has been locked in the bayonet lock, the force of the spring 340 tends to press the locking ring outwards, which is upwards in this drawing such that the protrusion cannot pass the notch 125 without generating counter pressure against the spring.

Figure 5:
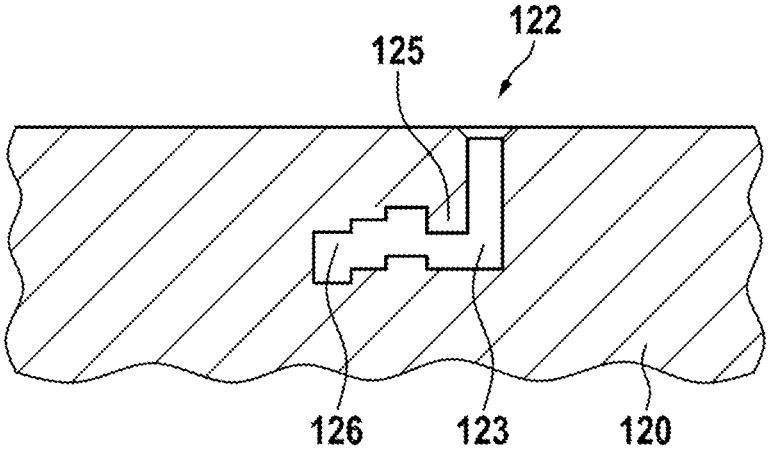
FIG. 5 shows a detail of another bayonet lock.

In FIG. 5, a detail of another embodiment of a bayonet lock is shown. Basically, this is similar to the previous embodiment, but has a modified second section 126. This second section 126 may have multiple sections with different heights. The bayonet lock protrusion 342 notch may engage with any of these sections resulting in a different position of the locking ring and therefore in different force of the spring 340. Here, by rotating the locking ring, the force may be adjusted.

Figure 6:
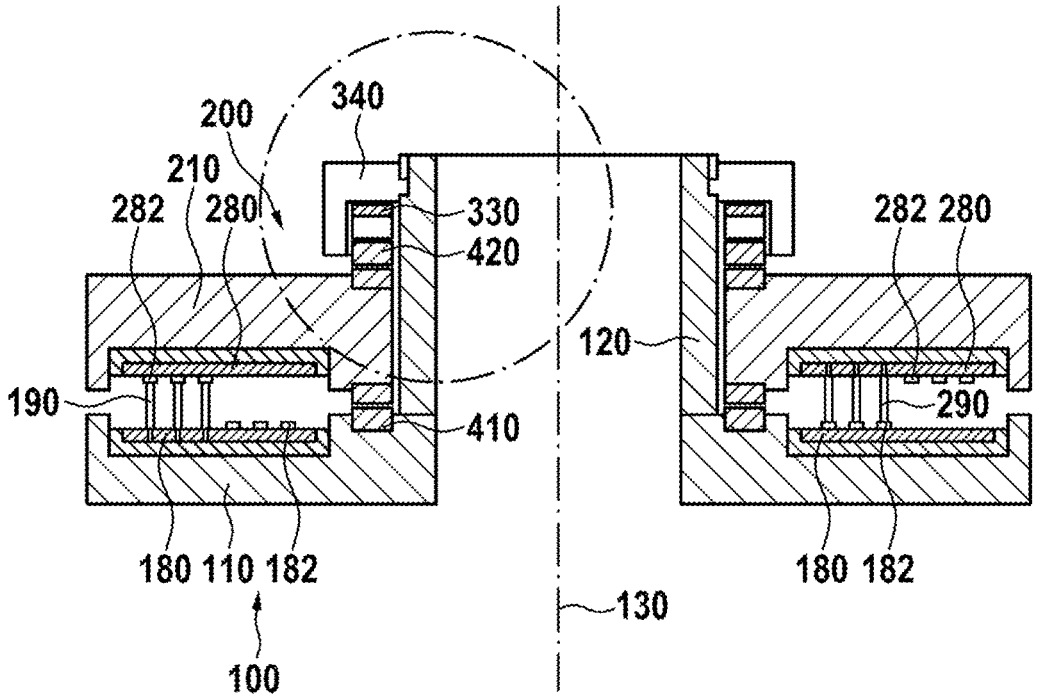
FIG. 6 shows a second embodiment of a slipring device.

In FIG. 6, a second embodiment of a slipring device is shown. The slipring device is similar to the slipring device of FIG. 1, but has different bearings. Here, instead of ball bearings, slide bearings, also called friction bearings are used. Such bearings have surfaces sliding against each other. In this embodiment, the ball bearings are replaced by a first slide bearing 410 and a second slide bearing 420.

Figure 7:
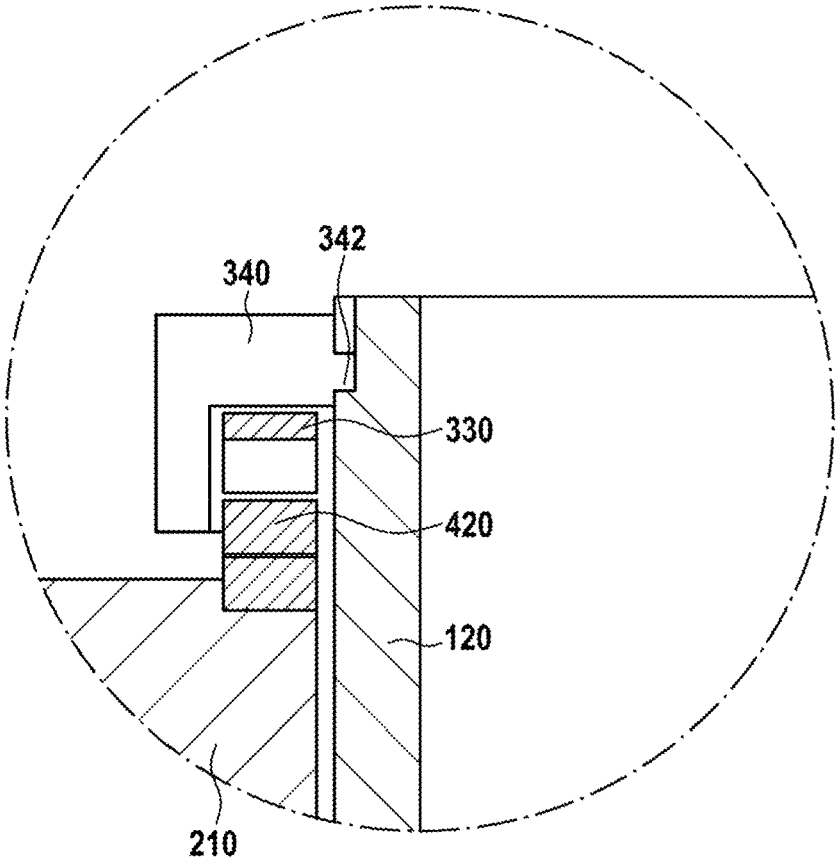
FIG. 7 shows a detail of the locking ring with bayonet lock and a slide bearing.

FIG. 7 shows a detail of the locking ring with bayonet lock and a slide bearing. This is a detail of the previous figure.

Figure 8:
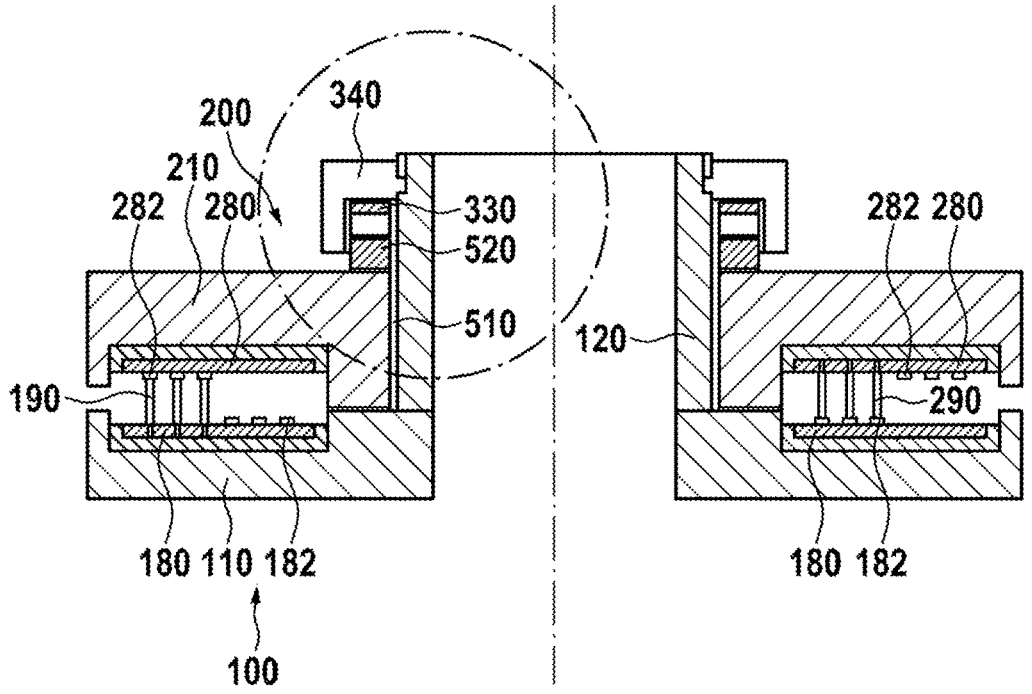
FIG. 8 shows a third embodiment of a slipring device.

FIG. 8 shows a third embodiment of a slipring device. Here, no discrete slide bearings are used as in the previous embodiment. Instead, the second housing 210 may be sliding within first housing 110 and hollow shaft 120. The first housing 110 and the hollow shaft 120 may also be one part. There may be a bearing gap 510 between the second housing 210 slidably against first housing 110 and hollow shaft 120. There may be a lubricant in the bearing gap.

Figure 9:
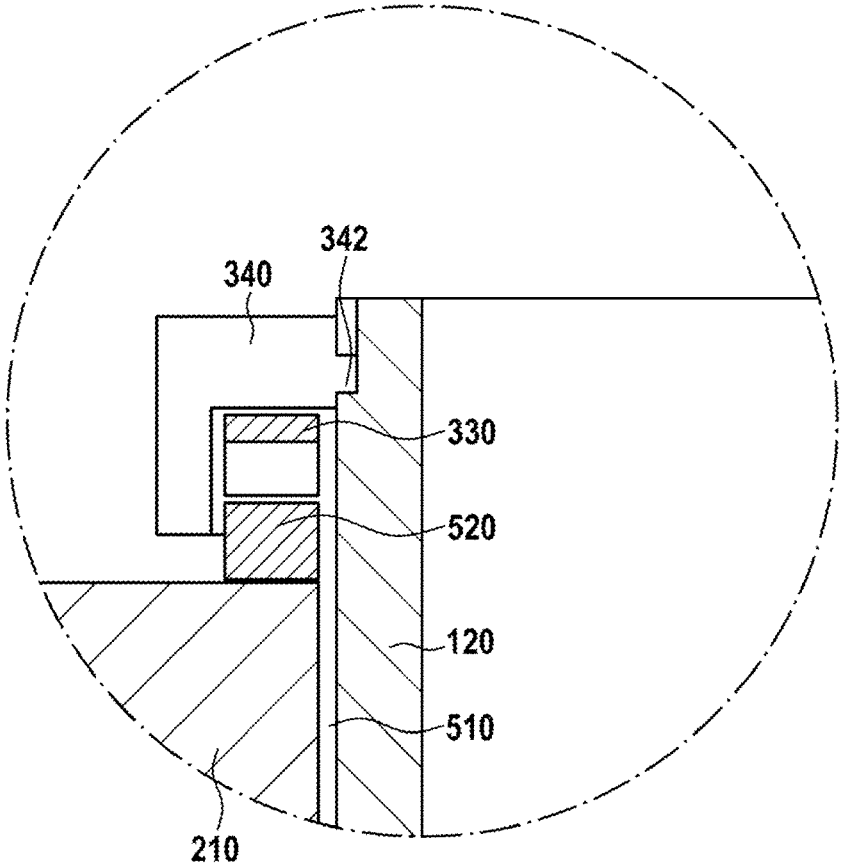
FIG. 9 shows a detail of the locking ring with a modified slide bearing.

FIG. 9 shows a detail of the locking ring of the previous embodiment. There may be a counter bearing 520 to hold the second housing 210 in place. This counter bearing may also be part of the locking ring.

Figure 10:
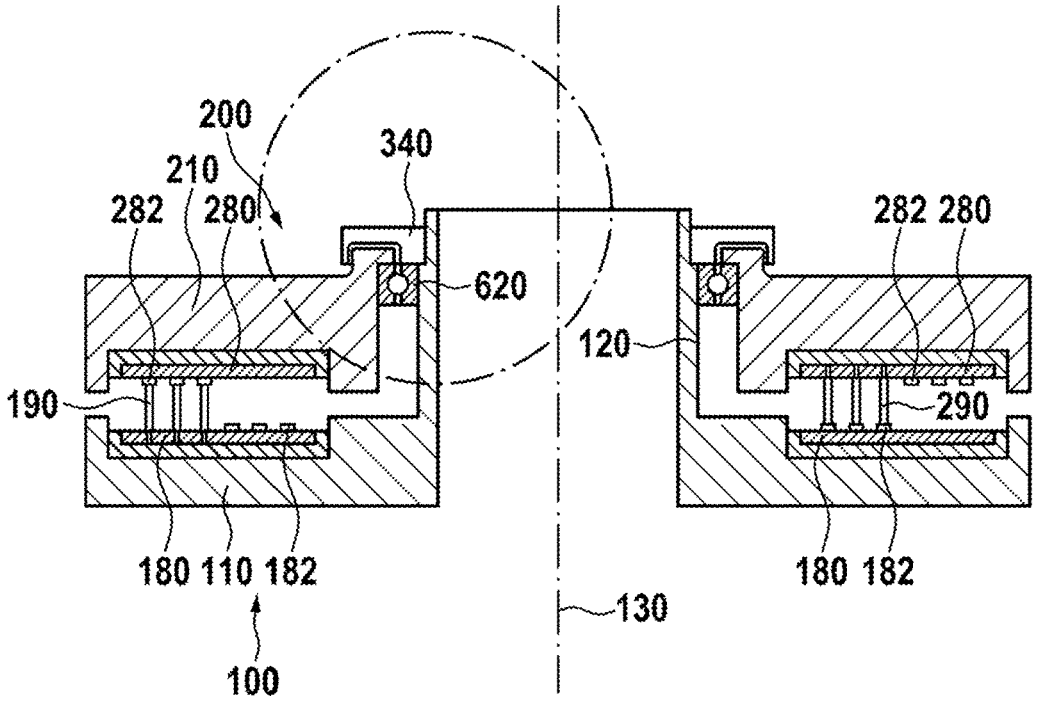
FIG. 10 shows a further embodiment of a slipring device.

In FIG. 10, a further embodiment of a slipring device is shown. The slipring device is similar to the slipring device of FIG. 1, but has only one bearing, which may be a ball bearing.

Figure 11:
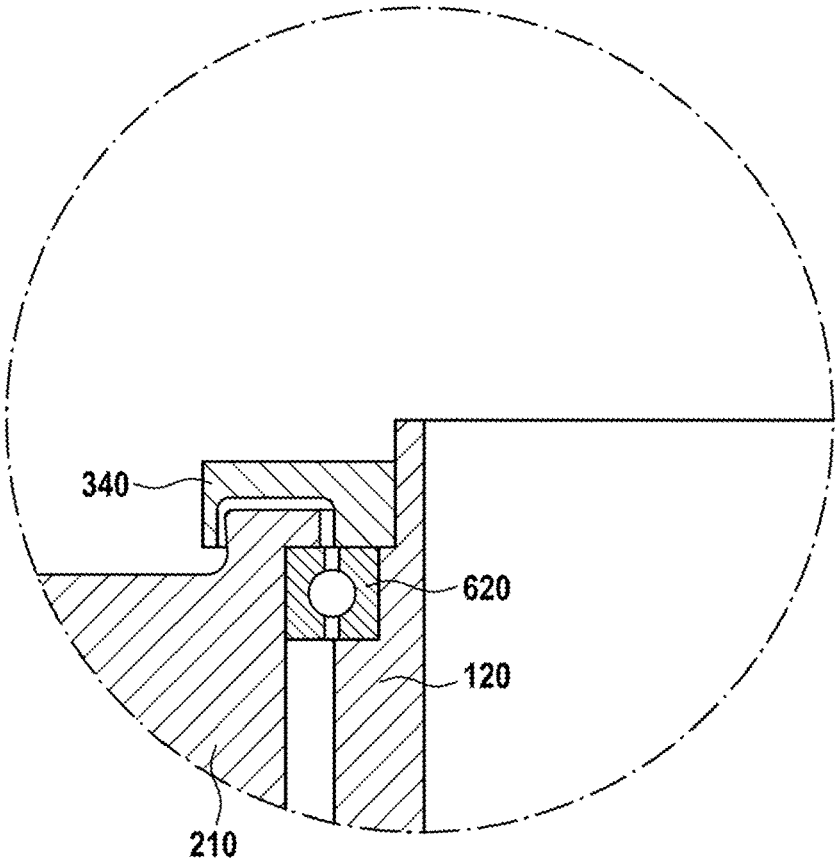
FIG. 11 shows a detail of the locking ring of the previous embodiment.

FIG. 11 shows a detail of the locking ring of the previous embodiment.

It will be appreciated to those skilled in the art having the benefit of this disclosure that this invention is believed to provide a slipring device. Further modifications and alternative embodiments of various aspects of the invention will be apparent to those skilled in the art in view of this description. Accordingly, this description is to be construed as illustrative only and is provided for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

100 first part
110 first housing
120 hollow shaft
122 bayonet lock notch
123 first section
124 second section
125 notch
126 multi-level notch
130 center axis
170 first connector
180 first printed circuit board
182 first sliding track
190 first contact brushes
200 second part
210 second housing
280 second printed circuit board
282 second sliding track
290 second contact brushes
310 first ball bearing
320 second ball bearing
330 spring
340 locking ring
342 bayonet lock protrusion
410 first bearing
420 second bearing
510 bearing gap
520 counter bearing
620 single ball bearing

The invention claimed is:

1. A slipring device comprising a first part and a second part arranged for relative rotation about a center axis, wherein:

the first part comprises a first housing holding at least a first slipring component;

the second part comprises a second housing holding at least a second slipring component;

a first bearing is arranged between the first housing and the second housing;

the first housing comprises a hollow shaft about which the second part and/or the second housing is/are disposed;

the hollow shaft comprising at least one bayonet lock notch;

the first housing further comprises a locking ring having at least one bayonet lock protrusion oriented in a radial direction to the center axis matching to the at least one bayonet lock notch;

wherein the locking ring is coupled to the outside of the hollow shaft and is configured to press against a spring between the locking ring and the second housing, in a direction parallel to the center axis, to hold the second housing against the first housing in a defined position; and a second bearing is arranged between the second housing and the locking ring.

2. The slipring device according to claim 1, wherein the spring is arranged between the second bearing and the locking ring.

3. The slipring device according to claim 1, wherein the spring is a wave spring or plate spring or disk spring.

4. The slipring device according to claim 1, wherein the spring is unitary with the locking ring.

5. The slipring device according to claim 4, wherein the spring and the locking ring both are made by a 3D printing process.

6. The slipring device according to claim 1, wherein the first bearing and the second bearing are each a ball bearing or a slide bearing.

7. The slipring device according to claim 1, wherein the first slipring component comprises a first printed circuit board which comprises at least one sliding track and/or sliding brush.

8. The slipring device according to claim 1, wherein the second slipring component comprises a second printed circuit board which comprises at least one sliding track and/or sliding brush.

9. The slipring device according to claim 1, wherein the first bearing is a ball bearing or a slide bearing.

10. The slipring device according to claim 1, wherein the hollow shaft has at least 2 bayonet lock notches or the hollow shaft has 3 bayonet lock notches.

11. The slipring device according to claim 10, wherein the bayonet lock notches are distributed at equidistant intervals along the circumference of the hollow shaft.

12. The slipring device according to claim 1, wherein at least the locking ring is made by a 3D printing process.

13. The slipring device according to claim 1, wherein at least one part of the slipring device is made by injection molding or comprises a metal.

14. The slipring device according to claim 1, wherein the first bearing is arranged between the first housing and the second housing in a direction parallel to the center axis.

15. A slipring device comprising a first part and a second part arranged rotatably against each other about a center axis, wherein:

the first part comprises a first housing holding at least a first slipring component;

the second part comprises a second housing holding at least a second slipring component;

the first housing comprises a hollow shaft about which the second part and/or the second housing is/are disposed;

a first bearing is arranged between the hollow shaft and the second housing;

the hollow shaft comprising at least one bayonet lock notch;

the first housing further comprises a locking ring having at least one bayonet lock protrusion oriented in a radial direction to the center axis matching to the at least one bayonet lock notch; and the locking ring is attached to the outside of the hollow shaft and is configured to hold the second housing against the first housing in a defined position.

* * * * *